United States Patent [19]

Kunczynski

[11] 4,179,994

[45] Dec. 25, 1979

[54] SUSPENDED ARTICULATED CHAIRLIFT MOUNTING ASSEMBLY

[76] Inventor: Jan K. Kunczynski, Boulder Cove, Box 256, Glenbrook, Nev. 89413

[21] Appl. No.: 841,813

[22] Filed: Oct. 13, 1977

[51] Int. Cl.[2] ..... B61B 7/12; B61B 11/00; B61D 33/00; F16D 3/58

[52] U.S. Cl. ..... 105/150; 104/173 ST; 105/329 SC; 297/184; 403/222

[58] Field of Search ..... 104/17, 173 ST; 105/150, 329 S, 148, 329 SC; 297/184, 273; 403/220, 221, 222, 223, 224, 225

[56] References Cited

U.S. PATENT DOCUMENTS

| | | | |
|---|---|---|---|
| 1,800,434 | 4/1931 | Christman | 403/224 X |
| 2,185,019 | 12/1939 | Stewart | 403/225 X |
| 2,677,331 | 5/1954 | Hauseman | 105/329 SC X |
| 2,699,199 | 1/1955 | Huntington | 105/329 SC X |
| 3,008,761 | 11/1961 | McIlvaine | 297/184 X |
| 3,134,342 | 5/1964 | Sorgo | 105/150 |
| 3,257,962 | 6/1966 | Doorley et al. | 104/17 |
| 3,257,965 | 6/1966 | Sneller | 104/173 ST |
| 3,747,974 | 7/1973 | Tauzin | 105/329 SC |
| 3,797,409 | 3/1974 | Frech | 105/150 X |

FOREIGN PATENT DOCUMENTS

| | | | |
|---|---|---|---|
| 1305220 | 4/1962 | France | 105/329 SC |
| 2274484 | 1/1976 | France | 105/329 SC |

*Primary Examiner*—Joseph F. Peters, Jr.
*Assistant Examiner*—Howard Beltran
*Attorney, Agent, or Firm*—Warren, Chickering & Grunewald

[57] ABSTRACT

A chair assembly mounting apparatus is disclosed which may be employed to mount a chair, gondola, platform, etc. to a hanger arm for use in a chairlift or the like. The apparatus provides a movable connection between the chair frame and hanger arm which reduces vibration and fatigue and yet damps or resists excessive motion. The mounting apparatus includes a rubber-like member which encircles a frame portion, preferably having a flange thereon, and in turn is encircled by a support housing rigidly mounted to the hanger arm. Movement of the frame relative to the hanger arm causes the flange to resiliently displace the rubber-like member.

9 Claims, 3 Drawing Figures

SUSPENDED ARTICULATED CHAIRLIFT MOUNTING ASSEMBLY

BACKGROUND OF THE INVENTION

Chairlifts, gondolas, ski lifts and other cable driven conveyancing apparatus of the type conventionally employed in the skiing industry are subjected to loading and vibrational forces which are substantial. Such apparatus are typically constructed with a hanger arm having one end formed for connection to a drive cable and a second end which is connected to a frame or bail on which is mounted a chair, gondola, seat or the like. As used herein, the expression "chair frame" will be understood to include frame elements used to support chairs, seats, platforms, gondolas, and similar personnel and equipment carrying apparatus.

The coupling between the hanger arm and the chair frame is subjected to high stress forces and substantial vibration loads. A reoccurring problem in connection with such structures has been, therefore, that rigid couplings between the hanger arm and chair frame tend to fatigue. Additionally, even when metal fatigue does not produce failure of the coupling, the vibrations are undesirably transmitted to both the personnel being conveyed by the system and other components of the system.

One solution to this problem is simply to pivotally mount the chair or gondola frame to the hanger arm. Typical of this type of approach is U.S. Pat. No. 3,008,761. This solution eliminates fatiguing at the coupling through vibration, but it produces a new problem, namely, undesirable swinging of the chair. A similar pivotal mounting structure is shown in U.S. Pat. No. 3,134,342.

In U.S. Pat. No. 3,257,965 a ski lift hanger arm mount is shown in which the end of the hanger arm which is connected to the cable gripping device is pivotally mounted, with nylon washers providing frictional damping of the pivotal movement. Wear due to friction and the attendant need for adjustment and replacement of parts are disadvantages of this system. While perhaps acceptable for applications in which the skier retains his skis in contact with the ski slope, large swinging motion inherent in this type of mount is not advantageous when a skier is suspended above the ground.

U.S. Pat. No. 3,747,974 is an example of a chair frame and hanger arm mount which is relatively complex in structure and primarily concerned with the use of chairlift motion to open and close a protective housing.

OBJECTS OF THE INVENTION

Accordingly, it is an object of the present invention to provide mounting apparatus for mounting a chair assembly to a hanger arm which is simple and inexpensive to construct and yet substantially eliminates fatigue and vibration at the coupling between the frame and hanger arm.

Another object of the present invention is to provide mounting apparatus for coupling a chair assembly to a hanger arm which enhances the ride comfort by eliminating vibration while minimizing chair swing.

Still a further object of the present invention is to provide mounting apparatus for coupling a chair assembly to a hanger arm in which relative movement between the chair assembly and hanger arm is permitted to avoid fatigue and the mounting apparatus may be easily adjusted to vary the movement permitted.

It is a further object of the present invention to provide a mounting apparatus for coupling a chair assembly to a hanger arm which is durable, easy to maintain, suitable for use in adverse environmental conditions, and may incorporate coupling means for indicia identifying the chair assembly.

The mounting apparatus of the present invention has other objects and features of advantage which will become apparent from or are set forth in the following description and accompanying drawing.

SUMMARY OF THE INVENTION

The chair assembly mounting apparatus of the present invention is formed for movably mounting of a chair frame to a hanger arm and comprises, briefly, resiliently displaceable means, and rigid support means mounted to one of the arm and frame and formed to couple, in cooperation with the resiliently displaceable means, the frame to the arm. The rigid support means engages and compressibly loads the resiliently displaceable means, and movement resistant means is also provided and formed to displace the resiliently displaceable means upon relative movement of the arm and frame. In the preferred form, a rubber-like block member is held inside a U-shaped housing attached to the hanger arm, and a frame portion or bail passes through the rubber block and has rigidly mounted thereon a flange, which engages and displaces the rubber block against the housing upon relative movement of the frame and hanger arm.

DESCRIPTION OF THE PREFERRED EMBODIMENT

Figure 1:
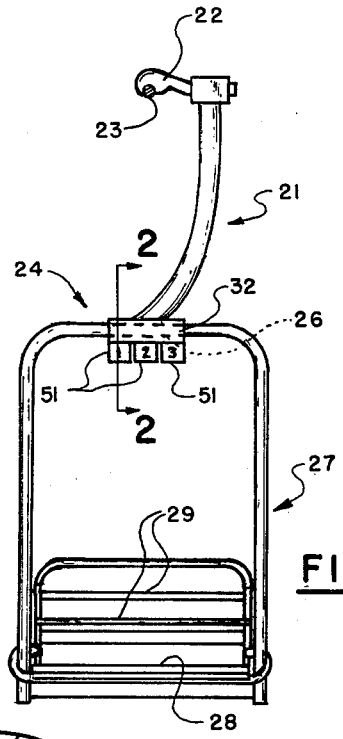
FIG. 1 is a front elevational view of a chair assembly mounted to a hanger arm by means of mounting apparatus constructed in accordance with the present invention.

FIG. 1 illustrates a chairlift assembly and hanger arm of the type conventionally employed in the skiing industry. Mounted to one end of hanger arm 21 is clamping means 22 formed for securement to or clamping down upon drive cable 23 in a conventional manner. The downwardly depending end of arm 21 is provided with mounting means, generally designated 24, constructed in accordance with the present invention and coupling or mounting bail or frame portion 26 of the chair assembly, generally designated 27, thereto. While hanger arm 21 is rigidly connected to clamping means 22, the coupling or mounting apparatus 24 of the present invention mounts frame portion 26 to the hanger arm in a manner permitting relative motion between the chair assembly and hanger arm. In the preferred form of the present invention, this relative motion is rotatable motion about the longitudinally extending axis 36 of frame portion 26, as will be more fully described hereinafter.

As will be appreciated, chair assembly 27 can also take the form of a gondola, rather than a chair having seat portion 28 and back portion 29. Thus, the "chair" can be an inclosed cabin, with a plurality of chairs, or even a platform on which skiers stand or equipment is placed. Moreover, the skier may have his skies in or out of engagement with the snow, and the chair assembly can, of course, be used for sightseeing and other personnel transport applications outside the skiing industry.

Although it is not regarded as being novel to provide a movable mount between hanger arm 21 and chair assembly 27, the movable mount of the present invention provides a simple, high strength, low maintenance manner of coupling these two elements together in a manner eliminating fatigue at the coupling and vibrations and swinging at the chair assembly. The construction of the mounting apparatus which accomplishes these ends can best be understood by reference to FIGS. 2 and 3. As will be seen, mounting apparatus 24 is comprised of a resiliently displaceable means 31, rigid support means, generally designated 32, mounted to at least one of arm 21 and frame portion 26, and movement resisting means 33. In the preferred form of the invention, resiliently displaceable means 31 takes the form of a rubber-like member or block having a transversely extending opening or passageway 35 in which frame portion 26 is mounted. Rigid support means 32 preferably takes the form of a generally U-shaped, downwardly depending and transversely extending, housing secured to arm 21.

In order to couple the frame of the chair assembly to the hanger arm, the support means or housing 32 is formed to engage resilient block 31 and to apply compressive loading thereto so that the frame portion 26 is, in effect, trapped or contained within housing 32 by compression of the rubber block 31.

It is a further feature of the present invention that the mounting apparatus be formed to cause displacement of resiliently displaceable means 31 upon relative movement of the hanger arm and frame, with such displacement generating resilient forces tending to resist such relative movement. In the preferred form of the invention, movement resistant means 33, in the form of a downwardly depending flange rigidly secured (for example, by welding at 34) to frame portion 26, is provided. Any rotation of the chair assembly 27 about longitudinal axis 36 of frame portion 26 will cause flange 33 to be displaced to the left or right of the position shown in FIG. 2. This displacement in turn displaces and compresses the rubber-like member 31 against one of the downwardly depending leg portions 37 or 38 of the U-shaped housing. Such compression of the resilient block resists the rotation about axis 36 and tends to urge the flange back to the position shown in FIG. 2.

Figure 2:
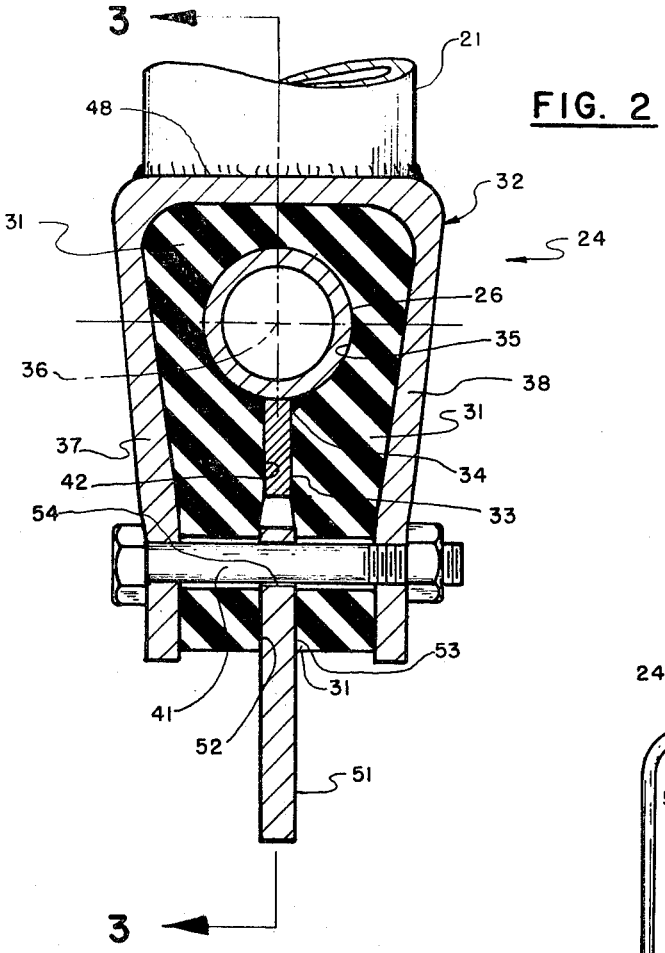
FIG. 2 is an enlarged, cross-sectional view, taken substantially along the plane of line 2—2 in FIG. 1.

In order to efficiently couple the frame portion or bail 26 to the hanger arm, it is preferable that the leg portions 37 and 38 of housing 32 converge toward each other slightly, and the lower ends of the leg portions 37 and 38 can be joined or coupled together by retaining means or fastener 41. As thus may be seen in FIG. 3, a plurality of fasteners 41 are preferably positioned along the length of the transversely extending U-shaped member 32, and these fasteners 41 can also be used as loading means to pull or displace the leg portions 37 and 38 toward each other so as to apply a compressive load to the rubber-like member 31 positioned therebetween. It is further preferable that rubber block 31 be formed with a slot or channel 42 dimensioned for receipt of flange 33. The compression load induced in member 31 by loading means or fastener 41 causes compression of the rubber member against flange 33. When the fastener is provided by a bolt, as shown in FIG. 2, it is possible to adjust the compressive load against flange 33 and the compression of the rubber block 31 against frame portion 26. This adjustment and pre-loading of the rubber block 31, in addition to trapping the frame portion 26 in the housing, allows the amount of resistance to rotation of the frame within the housing to be adjusted.

It is also important to note that the construction of the mounting apparatus of the present invention results in the fastener or loading means 41 being loaded virtually exclusively in tension. Thus, the pulling together of leg portions 37 and 38 by bolts 41 and the compressive loading of rubber member 31, locks the frame portion 26, and the weight carried thereby, in the housing without any substantial downward sheer force on the fastener 41. Moreover, the rubber block is removably positioned in housing 32 and need not be vulcanized or otherwise bonded to secure the chair frame to the hanger arm.

Figure 3:
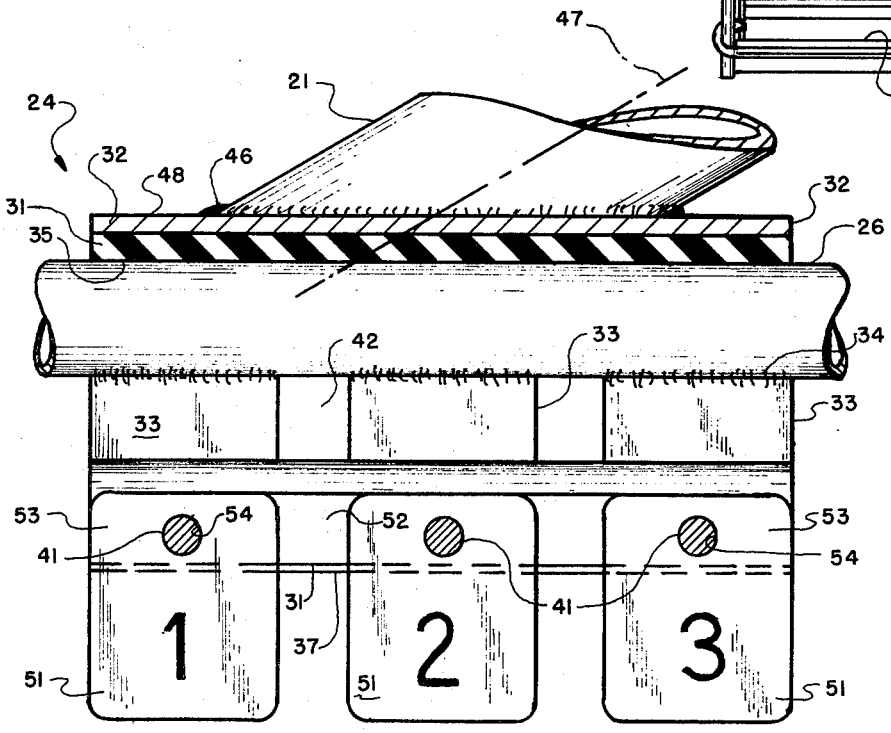
FIG. 3 is a fragmentary, cross-sectional view, taken substantially along the plane of line 3—3 in FIG. 2, in a slightly reduced scale.

As best may be seen in FIGS. 1 and 3, housing 32 is preferably secured to hanger arm 21 at a position vertically superimposed underneath cable 23. Such securement may be accomplished, for example, by welding at 46, and it is a feature of the present invention, in order to enhance rigidity and increase the area of the rigid coupling between housing 32 and arm 21, that the hanger arm and housing at the point of joining together be connected along an oblique angle. Thus, the axis 47 is skewed or inclined with respect to the top surface or base portion 48 of the U-shaped housing to increase the area of contact between the two.

Additionally, the housing 32 extends transversely along a substantial length of frame portion 26. In the preferred form of the invention, this length is equal to about 4 to 6 times the diameter of frame portion 26, and as can be seen in FIG. 2, the housing extends transversely to a distance on both sides of cable 23 which is approximately equal. Such a configuration enhances the stability of the chair assembly against lateral tipping.

As also may be seen in FIG. 3, it is preferable to provide a plurality of flanges 33 spaced apart from each other and secured to frame portion 26 by welding 34. These flanges and the portion 26 of the frame of the chair assembly mounted in housing 32 are preferably located at about the mid-portion of the bail or upper chair frame so that the weight in the chair will be relatively equally distributed. It will be understood that a single continuous flange extending longitudinally of frame portion 26 can also be used, but such a continuous flange will affect the stiffness of frame portion 26 more than a plurality of shorter flanges 33.

As will be appreciated, movement resisting means or flange 33 can be provided by other surfaces which engage and compressively load rubber block 31. For example, it would be possible to form the bail or frame portion 26 passing through the housing 32 as a rectangular or asymmetrical member. Such a member would include a surface or surfaces which would engage and displace the rubber block upon any rotation of the bail inside housing 32. The use of flanges 33 as the movement resistant means in the coupling of the present invention has the advantage of causing the compressive loading of resiliently displaceable rubber block 31 to occur at a distance from the center 36 of rotation, which location is radially displaced from the center so as to enhance the righting moment or force tending to resist and dampen any rotation. Similarly, other rigid support housings would be suitable for use with the present invention as long as they cooperatively engage the resilient block member with movement resistant means so as to produce displacement of the resistant means in a manner resisting relative movement.

Finally, it is a further feature of the present invention that the mounting apparatus be formed so that indicia carrying means 51 can be secured to the chair assembly frame. As shown, the slot 42 in rubber block member 31 is enlarged at slot portion 52 and is dimensioned to receive the upper ends 53 of the indicia carrying members 51. Also formed in the upper ends 53 is an opening 54 dimensioned for receipt of fastener 41 therethrough. Thus, the rubber block 31 compressively grips the indicia carrying member 51, and fastener 41 passing through openings 54 positively retains the indicia carrying members 51 to the mounting apparatus. Since it is not uncommon for chairlift lines to include over 100 chairs and since each chair may be advantageously identified with its own particular distinguishable indicia, it is preferable for the mounting apparatus of the present invention to provide three separate, side-by-side fasteners 41 with associated three separate indicia carrying members 51. As so constructed, indicia carrying members 51 need only have numbers from 0 to 9 and the mounting apparatus can be used to distinguishably identify 1,000 chairs.

The mounting apparatus of the present invention can be formed from a number of different combinations of materials. It is preferable, however, to form housing 32 of mild steel having a thickness of about ⅜ inches, which can be readily welded to hanger arm 21, also conventionally formed of steel tubing. Rubber block 31 can be pre-molded with transversely extending passageway 35 and slot 42 molded therein. It is preferable to mold the rubber block member of a synthetic or natural rubber having a durometer of about 75. The fasteners 41 can be ⅝ inch diameter bolts and steel flanges 33 preferably have a thickness of about 3/16 inches and extend radially from frame portion 26 to a distance of about 1 inch. The indicia carrying members 51 can be formed from plastic or metal.

The chair assembly mounting apparatus of the present invention can be easily installed during manufacture of the chair assembly. Moreover, it is a relatively simple matter to replace indicia carrying members 51 and rubber block 31. One need only remove the fasteners 41 from the assembly and pull the indicia carrying members out. In the case of replacement of the rubber block, the rubber block can be transversely pushed out of housing 32, since it is not vulcanized, sealed, bonded or adhesively secured to the housing, and then slot 42 enables the block to be pried off of the frame portion. Similarly, a new block member can be mounted on the frame portion 26 and then pushed into housing 22, whereupon the fasteners 41 can be mounted through the legs to secure the mounting apparatus together as a unit.

What is claimed is:

1. Chair assembly mounting apparatus for movably mounting a chair frame to a hanger arm including, a housing rigidly mounted to at least one of said arm and said frame, a resiliently displaceable rubber-like member positioned inside said housing, said housing and said rubber-like member being shaped for cooperative coupling of said frame to said arm, said housing being further shaped to apply a compressive load to said rubber-like member, and movement resisting means mounted to one of said frame and said arm and formed to displace said rubber-like member upon relative movement of said arm and said frame, wherein the improvement in said chair assembly mounting apparatus comprises:

said rubber-like member being formed with a transversely extending opening therein, a portion of one of said arm and said frame being mounted to pass through said opening in said rubber-like member, and said portion being rotatably movable about the longitudinal axis of said opening to cause displacement of said rubber-like member by said movement resisting means in a manner resisting said relative movement.

2. The mounting apparatus as defined in claim 1 wherein, said movement resisting means includes a surface on said portion formed and oriented with respect to said opening in said rubber-like member to resist rotation of said frame with respect to said rubber-like member and to effect resilient displacement of said rubber-like member upon relative rotation of said arm and said frame.

3. The mounting apparatus as defined in claim 2 wherein, said housing is mounted to said arm, said portion is provided as a portion of said frame, and said surface is provided by flange means rigidly mounted to said portion of said frame and engaging said rubber-like member, said flange means being oriented in a plane extending in a radial direction from and extending longitudinally of said opening.

4. The mounting apparatus as defined in claim 1, and loading means mounted to said housing and formed to enable the application of selected compressive loads to said rubber-like member.

5. The mounting apparatus as defined in claim 4 wherein, said housing includes at least one displaceable portion, and said loading means is provided by a fastener connected to said displaceable portion and formed to effect displacement thereof into engagement with and compressive loading of said rubber-like member.

6. The mounting apparatus as defined in claim 1 wherein, said housing is mounted to said arm and is formed as a transversely extending U-shaped channel member having side leg portions downwardly depending from said arm, said rubber-like member being formed to substantially fill the space between said side leg portions and said portion of said frame, and retaining means mounted to said housing for retaining said rubber-like member in said housing.

7. The mounting apparatus as defined in claim 6, and indicia carrying means formed with indicia capable of identifying a particular chair, said indicia carrying means being mounted in engagement with said rubber-like member, and said retaining means being further formed to couple said indicia carrying means to said mounting apparatus.

8. The mounting apparatus as defined in claim 6 wherein, said side leg portions converge toward each other, and said retaining means is provided by fastener means formed to extend between said side leg portions of said housing at a position below said opening in said rubber-like member, and said retaining means further is formed to enable selective adjustable displacement of said side leg portions toward each other to apply said compressive load to said rubber-like member.

9. The mounting apparatus as defined in claim 8 wherein, said portion of said frame is provided with a plurality of laterally spaced apart flanges rigidly mounted thereto and extending along said portion of said frame and radially therefrom, and said rubber-like member is formed with a transversely extending channel dimensioned to receive said flanges.

* * * * *